United States Patent [19]

McConnellogue

[11] 4,127,213

[45] Nov. 28, 1978

[54] EASY-OPEN PUSH-TAB END FOR METAL CONTAINERS

[75] Inventor: Neal J. McConnellogue, Lakewood, Colo.

[73] Assignee: Entech Corporation, Englewood, Colo.

[21] Appl. No.: 747,100

[22] Filed: Dec. 3, 1976 (Under 37 CFR 1.47)

Related U.S. Application Data

[63] Continuation of Ser. No. 623,758, Oct. 20, 1975, abandoned.

[51] Int. Cl.[2] ..... B65D 41/32

[52] U.S. Cl. ..... 220/268

[58] Field of Search ..... 220/268, 265, 266, 269, 220/270; 113/121 C; 222/541; 229/7 R

[56] References Cited

U.S. PATENT DOCUMENTS

| | | | |
|---|---|---|---|
| 3,334,775 | 8/1967 | Klein et al. | 220/268 |
| 3,779,417 | 12/1973 | Klein | 220/268 |
| 3,794,206 | 2/1974 | Deline et al. | 220/268 |

*Primary Examiner*—G. T. Hall

*Attorney, Agent, or Firm*—John E. Reilly

[57] ABSTRACT

There is disclosed an easy-opening convenience end for generally cylindrical containers in which an end closure has a push tab or gate panel formed out of the thickness of the end closure and displaced beneath the plane of the end closure with a folded protective edge circumscribing the outer periphery of the gate panel, except for a limited portion which defines a hinge section between the gate panel and end closure. The folded edge tapers or otherwise merges into the thickness of the end closure adjacent to the hinge section, and a line of weakening or separation is formed between the fold and gate panel by a metal shearing operation so as to permit opening of the end closure by depression of the tab inwardly about its hinge section.

Modified forms of ends incorporate relatively broad reinforcing areas in the closure surrounding opposite sides of the gate panel to facilitate intial separation of the gate panel away from the end. A reinforcing area within the gate panel takes the form of a raised pressure pad located adjacent to a corner at the leading end of the gate panel to aid in initial severance of the panel. In one of the modified forms, the gate panel or tab is raised upwardly through the aperture formed in the end closure, and a generally concave or depressed areas extends transversely of the length of the raised tab both to strengthen it and to encourage localized separation of the panel initially along its leading or outer drinking edge.

17 Claims, 18 Drawing Figures

EASY-OPEN PUSH-TAB END FOR METAL CONTAINERS

REFERENCE TO CROSS-RELATED APPLICATION

This application is a continuation of application Ser. No. 623,758, filed Oct. 20, 1975 now abandoned, and assigned to the assignee of the present application.

BACKGROUND OF THE INVENTION

This invention relates to a novel and improved convenience end for metal containers and the like, and more particularly relates to convenience ends of the type adapted for use with beverage or beer containers in which a gate panel or push tab is formed out of the wall of the end closure to form a separable opening therein.

Sheet metal containers typically used for food and beverage products have a generally cylindrical body portion and an end closure at each end to close off and seal the contents within the container. Innumerable approaches have been taken in the formation of openings in one end of the container for removal of the contents. In recent years, for example, beer and soft drink cans have tear portions or gate panels formed in the wall of one end of the can which can be selectively severed or otherwise separated from the end to form the opening therein. Representative end closures of this type are set forth in U.S. Pat. No. 3,779,417 to Klein for FLEX TAB FOR A GATED CAN LID and DeLine et al. U.S. Pat. No. 3,794,206 for FRANGIBLE OPENING MEANS FOR A CONTAINER LID, assigned to the same assignee of this invention. In each, the line of weakening or separation between the gate panel and rest of the end closure is formed in the outer protective edge, commonly referred to as the triple fold, along a section outwardly of the opening, and inward pressure is applied to the gate panel in order to cause its separation from the end. A number of advantages are realized in the use of a triple fold along the juncture of the gate panel and rest of the end closure, most notably the protective bead formed along the drinking edge of the can and substantial reduction in metal required in forming the entire end as well as overall economy in manufacture and formation of the gate panel in the least number of steps. Morever, the gate panel can be formed out of aluminum or steel and constructed in such a way as to form an effective seal with the end closure and to withstand the pressure of its contents; yet can be easily opened by inward manual pressure applied by the finger or thumb.

The aforementioned patent to DeLine et al. alludes to the advantages of combined coining or thinning of the triple fold or bead section followed by scoring same in forming the line of separation between the gate panel and lid. However, in mass production of lids there is a practical difficulty in maintaining close tolerances in coining or scoring the triple fold under repeated operations principally due to the tendency of the edge of the scoring punch to become dulled after repeated use. It is therefore highly desirable that the triple fold or bead be formed in such a way as to assure uniform thickness along the line of separation to be formed as well as to form the line of separation or weakening in such a way as to assure a continuous line of separation in each gate panel formed without necessity of constantly replacing or sharpening the tools.

Furthermore, it has been found that selective formation of stiffening areas in combination with the line of separation formed as described will afford much greater ease of opening, particularly initial severance of the gate panel away from the end closure. Moreover, it is desirable to form the gate panel in such a way as to provide for the widest possible opening size at the leading end of the pour opening as well as ease of separation of the panel away from the lid merely under finger pressure so that the gate panel can be displaced inwardly into the interior of the can.

SUMMARY OF THE INVENTION

It is therefore an object of the present invention to provide for a novel and improved easy opening lid for containers and method of making same.

It is another object of the present invention to provide an improved end closure for cylindrical cans and the like which incorporates in the wall of the end closure a novel and improved push tab which has sufficient strength to prevent accidental opening yet will readily and safely permit severance under manual pressure.

It is a further object of the present invention to provide for a novel and improved gate panel formed within the wall of an end closure for containers in which the gate panel is separated from the end closure by an interrupted, protective bead encircling the gate panel and whereupon application of inward manual pressure to the gate panel the gate panel will readily hinge inwardly and remain attached to the end closure when folded inwardly to the opening position.

It is an additional object of the present invention to provide for a novel and improved method of manufacturing a gate panel for a can end closure and the like in a minimum number of steps and requiring the least amount of metal in forming the gate panel out of the wall thickness of the end closure; and further wherein a unique form of protective bead is formed between the gate panel and end closure with a line of separation disposed radially outwardly of the opening or drinking edge.

Still a further object is to provide a novel and improved method of manufacgturing push tab ends and end closures for a cylindrical container and the like in which the gate panel is connected to the end closure by a unique interrupted fold which is formed in such a way as to leave a hinge section along a limited portion of the gate panel and the fold itself has a portion sheared away to form a line of separation just outwardly of the drinking edge.

In accordance with the present invention, an end closure for beverage cans and the like has a gate panel preferably of generally U-shaped or oval configuration formed out of its wall thickness, the gate panel separated from the end closure by an outer protective bead in the form of an interrupted fold which undergoes an outward reversal then inward reversal from the wall of the end closure into the gate panel; however a line of separation is formed between the gate panel and fold by shearing away the edge of the fold at its point of inward reversal into the gate panel. The fold also tapers both in width and thickness for a limited distance along opposite sides of the gate panel in a direction away from the closed end of the panel and gradually merges into the plane of the end closure so as to leave an uninterrupted hinge portion between the gate panel when the gate panel is separated from the end closure to form the opening.

In the method of forming the convenience end hereinabove described, the end closure may be formed out of a metal blank or shell having a central panel and outer surrounding rim or flange adapted for interconnection to the wall of a container. A portion of the central panel is first deformed in an axial direction away from the plane of the panel into an inner, axially offset gate panel portion which is joined by an axially directed, encircling wall section to the central panel. In deforming a portion of the central panel away from the plane of the panel, an oppositely directed force is applied to the inner gate panel to define an elongated or longitudinally extending medial rib or convex section therein. Next, by folding the wall section while spreading or flattening the rib, the wall section is caused to be compressed into a tightly folded bead or triple fold which undergoes a first radially outward reversal followed by a radially inward reversal into the inner gate panel. A line of separation if formed by shearing through the radially inward fold of the wall section and displacing the metal into the plane of the first fold. A sealant then may be applied in a conventional manner around the line of separation to seal the gate panel to the end closure.

In modified forms of the present invention, a broad reinforcing or stiffening area is defined out of the thickness of the end closure which includes a main stiffening area formed in a radial direction away from the gate panel and relatively narrow divergent portions flanking opposite sides of the gate panel. The gate panel itself is provided with a button or raised pressure pad adjacent to one corner of the leading end to initiate tearing or inward displacement of the gate panel. In one modified form of invention, it has been found that the entire tab or gate panel can be drawn or raised through the recess in the lid except for the outer peripheral edges which remain beneath the surrounding edge of the lid; and a concave rib or depression is formed in the raised tab to define a hinge line which will encourage the gate panel to be symmetrically displaced away from the end closure more uniformly along opposite sides as it is progressively opened in response to an individual pressing downwardly upon the panel. The cooperative disposition and arrangement of the stiffening areas, rib and pressure pad permits formation of a gate panel in which the sides of the panel diverge away from an inner hinged section and intersect with relatively sharply angled, converging edges forming the leading or outer end of the gate panel where separation is to be initiated. The leading end of the modified gate panel is essentially of traingular configuration having relatively straight edges intersecting one another at a common point adjacent to the outer peripheral rim of the can and intersecting the divergent sides at right angles so as to form the broadest possible width at the pour opening while being capable of withstanding the pressure of the contents of the can.

The above and other objects, advantages and features of the present invention will become more readily understood and appreciated from the following description of preferred embodiments thereof when taken together with the accompanying drawings.

DETAILED DESCRIPTION OF THE PREFERRED EMBODIMENT

Figure 1:
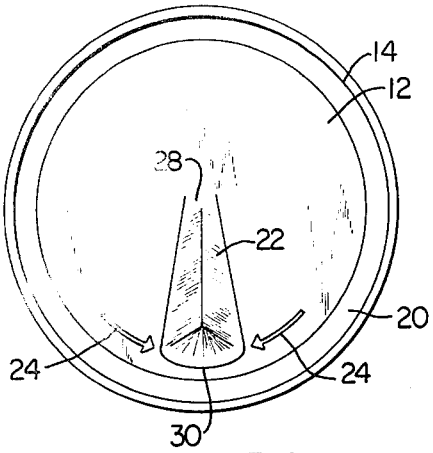
FIG. 1 is a plan view of a preferred form of end closure with easy opening push tab, in accordance with the present invention.
Figure 4:
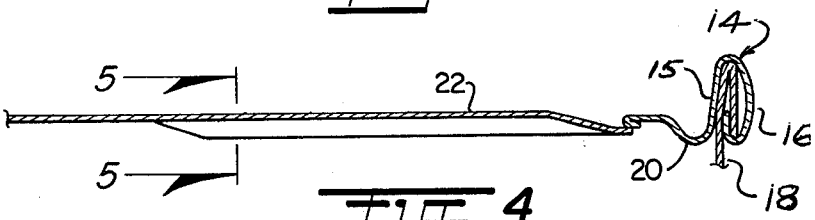
FIG. 4 is a cross-sectional view taken about lines 4—4 of FIG. 3.

Referring in detail to the drawings, a metallic end closure 10 is illustrated in FIG. 1 and in accordance with conventional practice comprises a substantially flat central panel 12 of circular configuration having an outer connecting rim or flange 14. As best seen from FIG. 4 the rim 14 conventionally includes an upstanding wall section 15 commonly referred to as a chuck wall and an outwardly disposed downwardly and reverse folded bead 16 which is adapted in association with the chuck wall to receive the upper open edge 18 of a generally cylindrical container body or can so as to completely seal off the end of the can. In addition, the central panel or lid section 12 may suitably include a peripheral groove 20 extending circularly around the panel or lid 12 inwardly of the outer connecting edge 14.

In accordance with the present invention, a tear-open tab or gate panel 22 is formed out of the thickness of the central panel 12 to extend radially from the center of the panel 12 to a point adjacent to and just inwardly of the peripheral groove 20. If desired, the gate panel may be flanked on opposite sides by suitable embossing represented in FIG. 1 in the form of arrows 24.

Referring in more detail to FIGS. 2 to 5A, the preferred form of gate panel 22 in accordance with the present invention is formed out of the material of the central panel 12 so as to be displaced directly beneath the plane of the panel 12 and is of generally U-shaped configuration having opposite straight sides 25 and 26 diverging away from one another slightly in an outward radial direction from the inner end of the panel leaving a hinge portion 28 in a manner to be described and terminating in an outer curved end 30. The gate panel also includes a convex medial rib 32 extending in a radial direction from the inner end or hinge portion 28 to merge into divergent rib portions 33 and 34 adjacent to the outer end 30, the ribs being raised above the plane of the opposite edges 25 and 26 of the gate panels so that at their highest point the ribs are in the plane of the lid section or panel 12. In turn, opposite edges 25 and 26 as well as outer surrounding edge 30 of the panel are spaced inwardly of the lid or panel section 12 by an outer progtective bead in the form of an underfold 36, as best seen from FIG. 5A. The fold 36 undergoes a downward and outward reversal from the plane of the lid section 12 to form a single thickness of metal separating the gate panel 22 and central panel 12. As will become apparent from the method of making the gate panel hereinafter described, normally the fold 36 would continue into a downward and inward reversal 38 into the plane of the outer edges of the gate panel. However, in the formation of a line of separation designated at 40 between the gate panel 22 and central panel 12, that material forming the lower portion of the fold 38 is sheared away from the underfold into the position as illustrated at 38' leaving a recessed area or corner of substantially right angle configuration between the outer peripheral side edge 42 of the gate panel and the underfold 36 of the lid. Although not shown, this area may be filled with a sealant for example in the manner described in the hereinbefore referred to DeLine et al. U.S. Pat. No. 3,794,206.

From the foregoing, it will be seen, therefore, that the gate panel extends from a hinge section at its inner end 28 in the plane of the lid or central panel 12 radially outwardly and inclined downwardly into outwardly divergent, opposed side edges 25 and 26 and outer surrounding edge 30, the gate panel being separated from the central panel by a downward and outward underfolded portion 36. In opening the can, downward pressure exerted manually by the thumb or finger upon the gate panel 22 adjacent to its outer curved end 30 and most desirably at the intersection of the rib sections 32, 33 and 34 will cause the panel to be hinged downwardly away from the central panel along the line of separation 40 so as to form an access opening into the interior of the can. The moment force applied about the inner end 28 of the gate panel will cause the gate panel to be hinged downwardly about this point but remain intact with the central panel. In this relation, the underfod 36 will from a protective bead or drinking edge around the peripheral edge of the lid surrounding the gate panel to avoid injury to the thumb or finger in opening and of course to prevent cutting or discomfort in drinking from the can.

Figure 2:
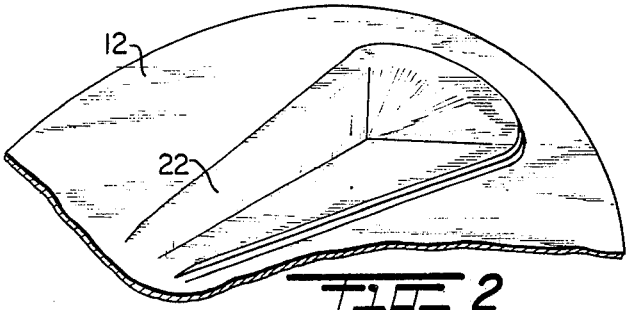
FIG. 2 is a somewhat fragmentary, perspective view of the push tab or gate panel when viewed from the underside of the end closure.
Figure 5:
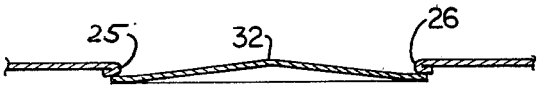
FIG. 5 is another cross-sectional view taken about lines 5—5 of FIG. 4.

As shown in FIG. 2, it is also highly desirable that the outer progtective bead or underfold 36 taper inwardly toward the inner terminal end of gate panel at opposite side edges so as to form a gradual reduction in thickness of the protective bead or in other words a gradual transformation between the plane of the central panel 12 into the downwardly displaced plane of the opposite side edges 25 and 26 of the gate panel 22.

Figure 6:
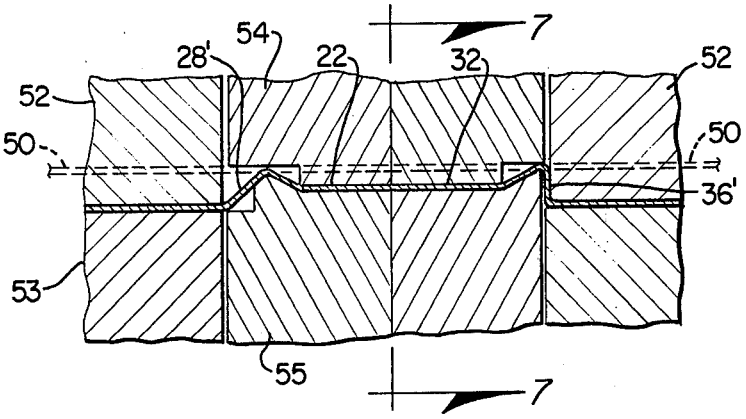
FIGS. 6 to 10 are fragmentary sectional views showing the successive steps followed in the formation of the preferred form of gate panel illustrated in FIGS. 1 to 5.
Figure 7:
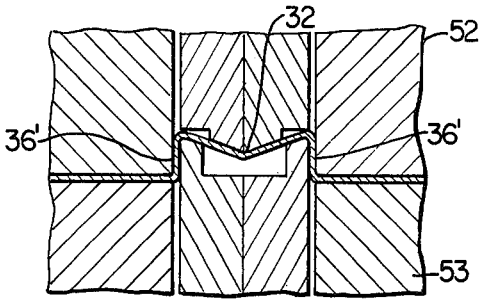

As described, the end closure of the present invention and novel construction of the gate panel lends itself particularly well to high volume mass production while maintaining or holding extremely close tolerances and permitting manufacture in a minimum number of steps. According to the preferred method or practice of carrying out the present invention, the central panel 12 is formed out of a metal sheet, such as aluminum or steel, as represented at 50 in FIG. 6, and which has an outer marginal region bent to form an outer connecting edge or rim 14 and inner concentric groove 20 formed in a conventional manner. As illustrated in FIGS. 6 and 7, the shell 50 is securely clamped between outer generally annular workholders 52 and 53, the lower holder 53 being retractible, such as, by means of resistance springs or nitrogen filled cylinders so that the outer surrounding portion of the panel or blank may be forced downwardly as shown with respect to the original plane of the central panel as represented at 50. Simultaneously the initial step of forming the gate panel 22 is carried out by causing the inner punch 54 to advance downwardly toward the inner die 55 in forming the medial ribs 32, 33 and 34 and outer surrounding wall section 36 as well as inclined wall section 28 at the inner end portion of the gate panel.

In the initial and following steps, it should be understood that the central panel 12 is disposed upside down and the gate panel is formed by drawing the shell downwardly as described. In the initial steps of drawing or axially displacing a portion of the material in forming the gate panel 22, the depth of the draw is such that the outer edges or corners of the panel 25, 26 and 30 are displaced at least three times the thickness of the panel, and the rib 32 is displaced approximately twice the thickness of the panel to afford sufficient material for folding the wall sections 36' in the next successive stage while flattening the rib to an extent sufficient to leave some degree of convexity as illustrated in FIGS. 1 to 5A.

Figure 5A:
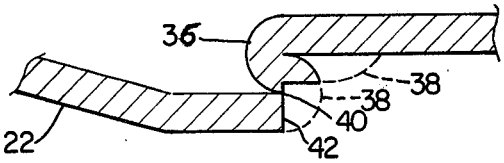
FIG. 5A is a fragmentary sectional view enlarged illustrating the line of separation formed between the gate panel end closure.

In the next successive stage, the panel or blank 50 is clamped between outer workholders 60 and 62 with the inner gate panel 22 interposed between an upper punch 63 and lower punch 64, the punches 63 and 64 being driven in opposite directions towards one another to partially flatten the medial rib 32 and cause outward lateral spreading of the metal toward the wall section 36 as the upper punch 63 is urged downwardly to fold the wall section upon itself into a lower fold configuration 38 as previously described with reference to FIG. 5A. In this stage, in folding the wall section it is also coined or compressed only to a degree sufficient to insure that it is of uniform thickness around the edge as a preliminary to the final shearing operation. Further the rib section 32 is partially flattened to the degree illustrated in FIG. 9 by the convex surface portion 65 and complementary concave surface portion 66. In this way, the apex of the rib 32 is in the plane of the central panel except at the inner end 28 where the rib is fully flattened. As best seen from FIG. 2, the lower fold section 38 in the area adjacent to the inner end gradually tapers toward the inner end as a result of the lesser amount of metal available in that area from flattening of the rib 32.

Figure 3:
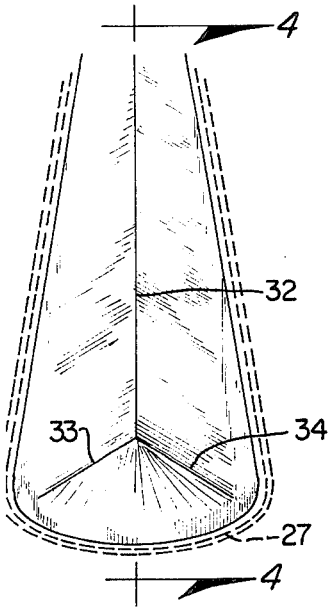
FIG. 3 is an enlarged plan view of the preferred form of push tab end illustrated in FIGS. 1 and 2.

In the final stage of the gate panel forming operation, the blank 50 is interposed between outer workholders 70 and 71, and the gate panel section 22 is interposed between an upper shearing punch 72 and a lower die 74. The shearing punch is characterized by having a central recessed area 75 and an outer, downwardly projecting shearing portion 76 of generally U-shaped configuration corresponding to the configuration of the gate panel, for example as illustrated in FIGS. 1 to 3, with the inner corner or edge 77 of the shearing tool being slightly relieved; i.e., the inner surface is inclined to be at an angle less than 90° so that in shearing through the lower fold 38, it will not frictionally engage the material behind the shearing edge 77 and will further tend to force the metal as it is sheared away from the triple fold against the undersurface of the blank 50. The shearing operation is carried out so that the lower fold portion is completely removed from the full thickness of the gate panel so as to form the desired line of separation 40 between the gate panel 22 and folded portion 36.

Once sheared, it may be desirable to force the gate panel to be urged or biased against the underside of the center panel at its line of separation; and when the central panel is suitably embossed with additional ribbing or indicia such as the arrows 24 shown in FIG. 1, the gate panel may be struck along the rib portion so as to cause the outer edges of the gate panel to be urged against the undersurface of the center panel. Although the method described is particularly useful in making convenience ends for containers, it is readily comformable for other applications where it is desirable to form a readily separable tab or gate panel portion in offset relation to a folded surrounding edge. It will be further apparent that various conventional sealants may be applied in a well-known manner to seal the gate panel 22 against the central panel 12 prior to opening.

In the modified form of invention shown in FIGS. 11 to 14, like elements of the end closure 10' are correspondingly enumerated; namely, a central panel 12 of generally circular configuration having an outer connecting rim or flange 14 and a peripheral groove 20 extending around the panel 12 just inwardly of the connecting edge 14. A modified form of tear-open tab or gate panel 22' is formed out of the thickness of the central panel 12 with the major axis of the gate panel 22' extending radially from the center of the panel 12 to a point adjacent to and just inwardly of the peripheral groove 20.

Figure 11:
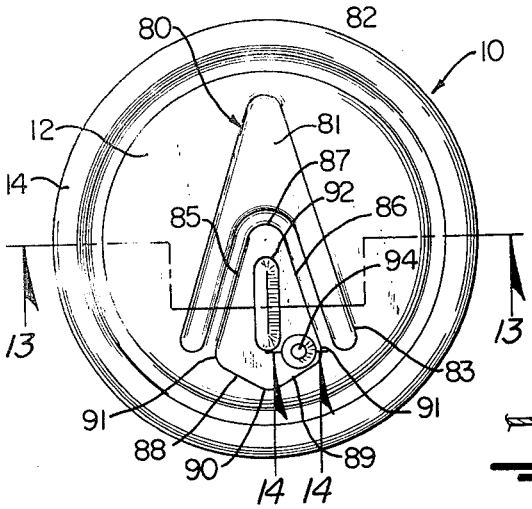
FIG. 11 is a plan view of a modified form of the present invention.
Figure 12:
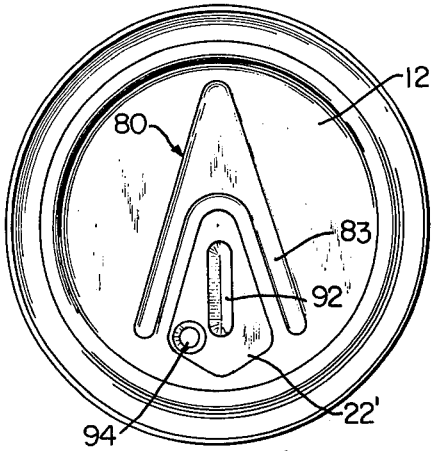
FIG. 12 is a plan view of the modified form shown in FIG. 11 when viewed from the underside of the end closure.
Figure 13:
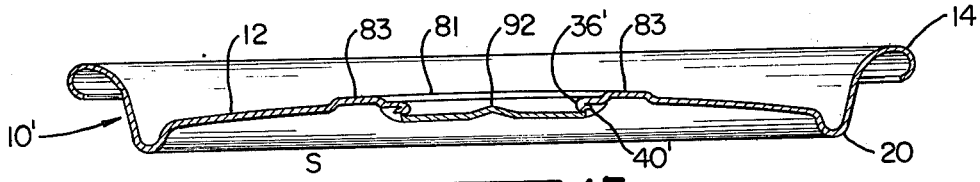
FIG. 13 is an enlarged cross-sectional view taken about lines 13—13 of FIG. 11.

Preliminary to describing the modified form of gate panel 22', it will be noted that the main or central panel 12 is also modified by provision for a broad reinforcing or stiffening area generally designated at 80 and which is of generally V-shaped configuration as viewed in the plan views of FIGS. 11 and 12. The area 80 is formed out of the thickness of the central panel so as to be raised above the plane of the panel 12 and define a relatively broad reinforcing section 81 tapering in a direction away from the center of the panel 12 toward the closed end of the Vee as represented at 82. Opposite sides of the Vee essentially define divergent fingers 83 which flank opposite sides of the gate panel 22' and leave a narrow spacing 84 which is of generally U-shaped configuration and of uniform width between the opposite sides of the gate panel and the insides of the stiffening area 80.

Now considering the particular configuration of the gate panel 22', it is provided with opposite straight sides 85 and 86 diverging away from a common, generally U-shaped center portion 87 and extending in an outward radial direction for intersection with leading convergent straight edges 88 and 89 at the leading or outer end of the gate panel adjacent to the groove 20. The convergent edges 88 and 89 meet at a common point of intersection 90 at the forward extremity of the gate panel and also intersect with the sides 85 and 86, respectively, to define corners 91 therebetween. A generally convex medial rib 92 extends in a radial direction along the major axis of the gate panel and for the greater length of the panel but terminates at a point just inwardly of the corners 91, the rib 92 being formed out of the material of the gate panel and being raised above the plane of the opposite side edges 85 and 86, as best seen from FIG. 13, so as to define a stiffened area centrally of the panel.

Figure 14:
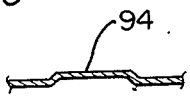
FIG. 14 is another cross-sectional view taken about lines 14–14 of FIG. 11.

In addition, a pressure pad 94 is formed out of the material of the gate panel so as to be raised above its plane at a point adjacent to the corners 91, the cross-sectional configuration of the pressure pad being illustrated in FIG. 14. In essence, the pressure pad 94 defines a button or pressure point against which localized thumb or finger pressure is applied to initiate displacement of the gate panel inwardly away from the main panel 12.

Unlike the preferred form of invention, the gate panel 22' is displaced downwardly or inwardly from the plane of the central panel 12 uniformly throughout its peripheral extent, as opposed to merging into the plane of the central panel at the inner or central hinge section, such as, that illustrated at 28 in FIG. 1. Again, however, an outer protective bead in the form of an underfold 36' extends between the outer peripheral edge of the gate panel and the surrounding edge of the central or main panel 12 so as to undergo a downward and outward reversal from the plane of the panel 12 into a single thickness of metal separating the gate panel 22' and central panel 12; and an area of separation designated at 40' extends between the gate panel 22 and central panel 12, the area of separation once again being formed by shearing a lower portion of the fold 38' away from the underfold and forcing the displaced metal outwardly against the underside of the panel 12. The recessed area left as a result of upward shearing of the metal is filled with a sealant or hot melt S, again in the manner described in the preferred form. It should be stressed in this connection, however, that the shearing of the gate panel away from the outer protective bead is interrupted at the central or hinge point 87 so that when the gate panel is displaced inwardly it will bend inwardly about the hinge section and will not be separated at that point from the central panel.

Figure 15:
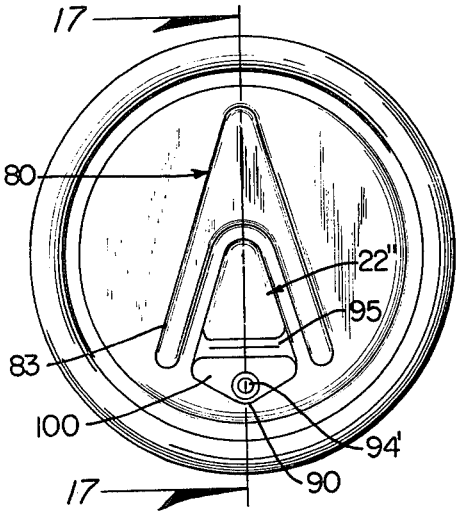
FIG. 15 is a plan view of still another modified form of end closure in accordance with the present invention characterized by having a transverse depression formed out of the raised body of the gate panel.
Figure 16:
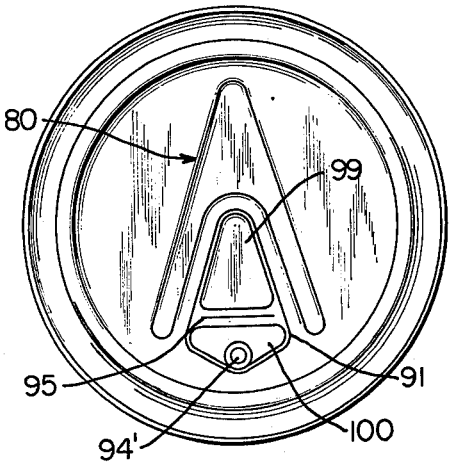
FIG. 16 is a plan view of the underside of the modified form of end closure shown in FIG. 15.
Figure 17:
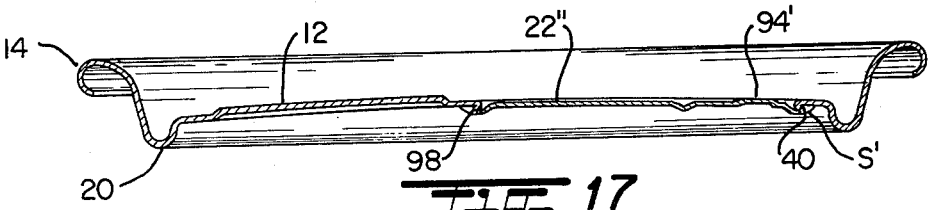
FIG. 17 is a cross-sectional view taken about lines 17—17 of FIG. 15.

In still another modified form of invention as illustrated in FIGS. 15 to 17, like parts are once again correspondingly enumerated. In this form, the central panel 12 is provided with a broad reinforcing area 80 in surrounding relation to still another modified form of gate panel 22''. The formation of the stiffening area 80 and of an outer protective bead and area of separation 40' between the gate panel and underfold of the central panel corresponds to that described with reference to FIGS. 1 to 5A or FIGS. 11 to 14. However, once the gate panel is displaced downwardly beneath the plane of the center panel 12 and prior to shearing of the opposite side edges 85, 86 and 88, 89, the gate panel 22'' is displaced upwardly into the plane of the center panel 12 while displacing an intermediate transverse cross-section of the panel downwardly to form a concave depression or cross-beam 95 in the gate panel 22'. It will be noted that the displacement of the gate panel in an upward direction into the plane of the center panel will form a slight upward bend at the juncture of the gate panel with its outer peripheral edges, as indicated at 98 in FIG. 17, throughout the entire periphery of the panel so that the outer peripheral side edges 85, 86 and the leading edges 88 and 89 may be sheared to form an area of separation therebetween in the same manner as described with reference to the preferred and modified forms of invention. Furthermore, formation of a transverse rib or depression 85 intermediately of the gate panel will in effect separate the gate panel 22' into adjoining raised tab sections 99 and 100. The depth of the depression 95 is such as to be disposed in the plane of, and to merge into, the outer protective edfes 85, 86 and 88, 89.

In the same manner as described with reference to the modified form of FIGS. 11 to 14, a pressure pad 94' is formed out of the thickness of the gate panel so as to be disposed slightly above the plane of the gate panel 22'' and center panel 12. In this form, the pressure pad 94' is located at or contiguous to the forward extremity 90 defined by the intersection of the leading edges 88 and 89 so that localized pressure applied by the finger or thumb at that point will initiate tearing or downward displacement of the gate panel away from the center panel at the forward extremity of the gate panel 22'. A sealant S is applied to the sheared section formed at the area of separation between the gate panel and center panel in the same manner as described in the preferred form or modified forms so that the gate panel is normally retained in sealed relation to the underfolded edge or protective bead 36' of the center panel.

A number of important advantages accrue from the formation of the gate panel 22'' so as to be defined as the raised tab portions 99 and 100 separated by the transverse rib 95; for instance, the tab portions 99 and 100 will in general increased the strength or rigidity of the gate panel and better resist any pressure build-up in the can, will discourage any build-up of dirt or foreign particles which might otherwise collect in the recessed area between the gate panel and center panel, and will make the entire gate panel more readily accessible for application of downward pressure by the finger or thumb. The concave depression 95 further cooperates with the raised tab sections 99 and 100 in providing a weekened section or intermediate hinge to better promote initial tearing or separation of the forwardmost tab section 100 away from the center panel so that initial displacement of the forward tab section away from the panel 12 will permit venting or release of any pressure build-up in the can as a preliminary to displacing the rearward can section downwardly away from the center panel 12. If desired, the concave depression 95 may also be coined or thinned to some degree in order to provide a weakened hinge section at that point without weakening the overall strength of the gate panel.

From the forgoing description of the method and sequence of operations followed in formation of the gate panel it will be seen that the gate panel can be formed out of the wall thickness of the center panel with an outer protective edge initially in the form of a triple fold and which is converted to a single fold by shearing away the lower portion of the fold which is directed inwardly into the gate panel. Use of a shearing tool in this manner not only affords greatly increased accuracy and reliability in formation of the desired line of separation but minimizes dulling of the cutting edge of the shearing tool in that the tool itself is much wider and minimizes concentration of forces along one sharpened cutting edge or line.

Figure 8:
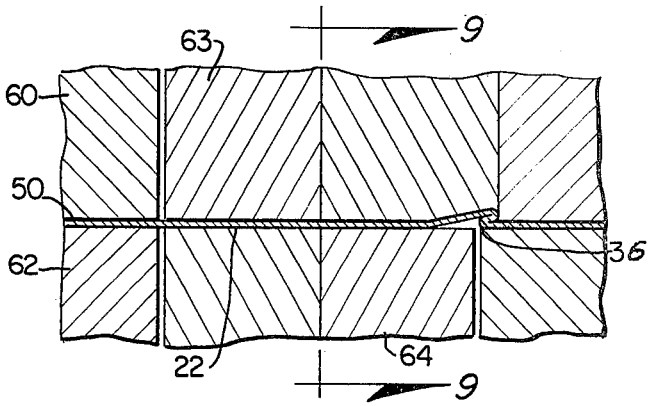
Figure 9:
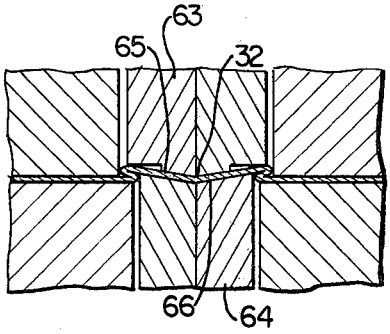
Figure 10:
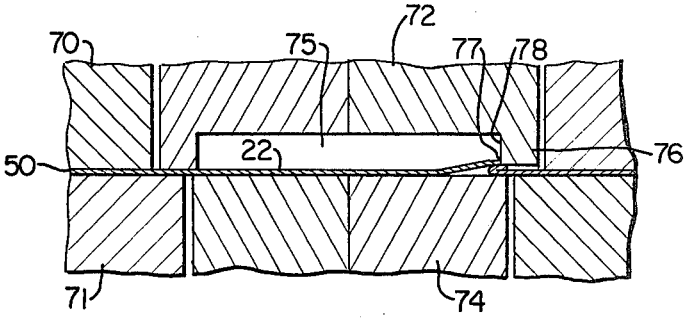

For the purpose of illustration and not limitation, easy-open, convenience ends made according to the hereinbefore described method may be suitably composed of an aluminum alloy, such as, 304H19, 5082H19 or 5182 aluminum alloys having a thickness on the order of 0.013 inch to 0.014 inch; or can also be composed of various steel materials such as a double reduced D-RT4 95-pound steel. In the initial draw or axial displacement as shown in FIGS. 6 and 7, the depth of draw as illustrated is on the order of six times the thickness of the material and the displacement in the center along the apex of the rib on the order of four times the thickness. In the next stage of folding and compressing the wall section as shown in FIGS. 8 and 9, the wall section is most desirably tightly folded so as to be approximately three times the thickness of the material and is coined along the fold to assure a uniform cut in the subsequent shearing operation. In the shearing operation as disclosed in FIG. 10, most desirably the shearing tool severs the gate panel from the fold at the inside point of reversal as best seen from FIG. 5Aso that a minimum amount of material is displaced while assuring a fairly clean line of separation between the gate panel and underfold 34. In this connection, the recessed area formed is well suited for application of a sealant which will at last partially fill in the recessed area and to some extent flow into the space formed along the line of separation between the gate panel 32 and underfold 34. Further to assure a continuous line of separation along the opposite side edges and rounded edge of the gate panel, most desirably the shearing tool will pass or advance to a limited extent into the underfolded section past the line of separation 40.

It will be appreciated from the forgoing that the unique method of manufacture as well as the resultant gate panel construction lends itself well to various configurations and sizes particularly in can lid manufacture. Moreover, the location of the hinge section with respect to the rest of the gate panel and the central panel may be varied and for example the gate panel may be so constructed and arranged as to have the hinge section along the outer periphery of the lid with the rounded end 30 located radially inwardly of the hinge. The fold or portective bead as described is interrupted both in the sense that it teminates on opposite sides of the hinge section or plane of the central panel and is sheared away in forming the line of separation. In this respect, the underfold may be formed endlessly so as to completely encircle the gate without leaving in interrrupted hinge section in the specific manner described, if for example it is for any reason desirable to permit complete detachment of the gate panel.

Accordingly, it is to be understood that various modifications and changes may be made in the preferred form of push-tab end as described as well as the method of making same without departing from the spirit and scope of the invention as defined by the appended claims and reasonable equivalents thereof.

What is claimed is:

1. An end closure for a container comprising:

a relatively flat panel having an outer peripheral connecting rim and a recessed portion forming an aperture in said panel for removal of contents from the container;

a reverse curved, underfolded edge portion at least partially surrounding the aperture, said underfolded edge extending in a plane along the underside of the panel, and a push tab traversing the aperture in said panel and including an outer peripheral edge underlying said underfolded edge portion, there being a line of separation disposed intermediately between the outer peripheral edge of said push tab and said underfolded edge portion extending in a plane parallel to said push tab, and means retaining said push tab in continuous contact with said underfolded edte portion whereby to close said aperture and being yieldable under manual pressure to be moved away from the aperture to open same for removal of the contents from the container.

2. An end closure according to claim 1, said push tab including a hinge portion forming a continuation of said panel downwardly into underlying relation to said underfolded edge portion, said underfolded edge portion terminating on opposite sides of said hinge portion and encircling the aperture except along said hinge portion.

3. An end closure according to claim 2, said push tab having a medially extending, convex rib, and an outer shear section forming a continuation of said underfolded edge portion above the line of separation.

4. An end closure of unitary construction for generally cylindrical containers and the like comprising:

an outer lid section and an inner gate panel formed in the lid section, said gate panel formed out of the thickness of said outer lid section to extend in a generally radial direction from an inner end in the plane of and adjacent to the center of said outer lid and teminating in an outer rounded end adjacent to and beneath the peripheral edge of said outer lid, said gate panel having opposite side edges diverging outwardly in a generally radial direction away from the inner end and being displaced beneath the plane of said outer lid leaving an aperture in said outer lid, an underfolded edge portion defining a continuation of said outer lid in surrounding relation to the aperture and extending continuously along and above the opposite side edges and outer end of said gate panel, said underfolded edge portion tapering inwardly at least along a portion of the opposite side edges of said gate panel toward the inner end thereof, and a line of separation formed between said gate panel and underfolded edge portion at least along the outer end and a portion of the opposite side edges to permit inward displacement and separation of said gate panel away from said outer lid.

5. An end closure according to claim 4, said underfolded edge portion being defined by a tightly folded section of metal undergoing a radially outward reversal from said outer lid into a plane directly beneath said lid section.

6. An end closure according to claim 4, said line of separation defined by a sheared metal section formed between the outer peripheral edge of the gate panel and said underfolded edge portion.

7. An end closure according to claim 4 in which said gate panel inclines downwardly from an inner end in the plane of said lid to extend in a plane substantially parallel to and beneath the plane of said lid.

8. An end closure according to claim 7 in which said gate panel includes a raised medial portion extending radially from the inner end toward the outer end thereof.

9. An end closure according to claim 4, said gate panel being generally of U-shaped configuration with opposite sides diverging outwardly away from closely spaced relation at the inner end into the outer end of said gate panel.

10. An end closure for a container comprising:

a lid section having an outer peripheral connecting rim and a recessed portion forming an aperture in said lid section for removal of contents from a container;

a reverse curved, underfolded edge portion at least partially surrounding the aperture, said underfolded edge extending in a plane along the underside of said lid section;

a gate panel including a main body traversing the aperture in said lid section, an outer peripheral edge underlaying and normally in contact with said underfolded edge portion, and a line of weakening being said peripheral edge of said gate panel and lid section, said main body offset above the plane of said outer peripheral edge to fill the aperture in said lid; and means normally retaining said gate panel in continuous contact with said underfolded edge portion along said line of weakening whereby to normally close said aperture, said gate panel being yieldable under manual pressure to be moved away from the aperture to open same for removal of the contents of the container.

11. An end closure according to claim 10, a pressure pad defining a raised surface area projecting upwardly from said main body beyond the surface of said lid section in an area adjacent to the leading end of said gate panel to assist in applying concentrated pressure to a localized area of said gate panel for separation of the gate panel inwardly away from said lid section, said pressure pad being formed out of the thickness of said gate panel.

12. An enclosure according to claim 10, said line of weakening defined by a line of separation extending in a plane parallel to and between said gate panel and said lid section.

13. An enclosure according to claim 10, said gate panel formed with a concave rib extending transversely of the major axis of the gate panel so as to form a depression in said gate panel intermediately between the inner and outer ends thereof.

14. An enclosure according to claim 10, said main body disposed in the plane of said lid section.

15. An end closure for a container comprising:

a lid section having an outer peripheral connecting rim and a recessed portion forming an aperture in said lid section for removal of contents from a container;

a reverse curved, underfolded edge portion at least partially surrounding the aperture, said underfolded edge extending in a plane along the underside of said lid section;

a gate panel traversing the aperture in said lid section and including an outer peripheral edge underlaying and normally in contact with said underfolded edge portion to define an area of separation therebetween extending in a plane parallel to said gate panel and lid section;

means normally retaining said gate panel in continuous contact with said underfolded edge portion along said area of separation whereby to normally close said aperture, said means being yieldable under manual pressure to be moved away from the aperture to open same for removal of the contents of the container; and a generally convex medial rib extending along the major axis of said gate panel and terminating at a point spaced inwardly of said pressure pad.

16. An end closure according to claim 15, the leading end of said gate panel having straight inclined edges intersecting one another at a point along the major axis of said gate panel and intersecting the opposite said gate panel to define corners symmetrically disposed with respect to the common point of intersection of said straight edges, and a pressure pad formed at one of the corners between the straight edges and opposite sides of the gate panel.

17. An end closure according to claim 16, said pressure pad being in the form of a generally circular protuberance projecting upwardly out of the surface of the body thickness of said gate panel.

* * * * *

UNITED STATES PATENT OFFICE

CERTIFICATE OF CORRECTION

Patent No. 4,127,213 Dated 28 November 1978

Inventor(s) McConnellogue, Neal J.

It is certified that error appears in the above-identified patent and that said Letters Patent are hereby corrected as shown below:

IN THE ABSTRACT:

Line 17, cancel "intial" and substitute -- initial --.
Line 24, cancel "areas" and substitute -- area --.

Column 1, line 53, cancel ".".
Column 2, line 43, cancel "manufacgturing" and substitute -- manufacturing --.
Column 3, line 52, cancel "traingular" and substitute -- triangular --.
Column 5, line 12, cancel "progtective" and substitute -- protective --.
Column 5, line 49, cancel "underfod" and substitute -- underfold --.
Column 5, line 50 cancel "from" and substitute -- form --.

UNITED STATES PATENT OFFICE

CERTIFICATE OF CORRECTION

Patent No. 4,127,213 Dated 28 November 1978

Inventor(s) McConnellogue, Neal J.

It is certified that error appears in the above-identified patent and that said Letters Patent are hereby corrected as shown below:

Column 5, line 56, cancel "progtective" and substitute -- protective --.
Column 6, line 38, cancel "towards" and substitute -- toward --.
Column 9, line 3, cancel "edfes" and substitute -- edges --.
Column 9, line 26, cancel "increased" and substitute -- increase --.
Column 9, line 35, cancel "weekened" and substitute -- weakened --.
Column 10, line 12 cancel "5Aso" and substitute -- 5A so --.
Column 10, line 17 cancel "last" and substitute -- least --.
Column 10, line 40 cancel "in" and substitute -- an --.
Column 10, line 40 cancel "interrrupted" and substitute -- interrupted --.

UNITED STATES PATENT OFFICE

CERTIFICATE OF CORRECTION

Patent No. 4,127,213 Dated 28 November 1978

Inventor(s) McConnellogue, Neal J.

It is certified that error appears in the above-identified patent and that said Letters Patent are hereby corrected as shown below:

Claim 1, Column 10, line 68, cancel "edte" and substitute -- edge --.

Signed and Sealed this

Ninth Day of October 1979

[SEAL]

Attest:

RUTH C. MASON
*Attesting Officer*

LUTRELLE F. PARKER
*Acting Commissioner of Patents and Trademarks*